US008829773B2

(12) United States Patent
Green et al.

(10) Patent No.: US 8,829,773 B2
(45) Date of Patent: Sep. 9, 2014

(54) LIGHTING APPARATUS WITH LIGHT-EMITTING DIODE CHIPS AND REMOTE PHOSPHOR LAYER

(71) Applicants: Adam Green, Boca Raton, FL (US); Eric Gutmann, Boca Raton, FL (US)

(72) Inventors: Adam Green, Boca Raton, FL (US); Eric Gutmann, Boca Raton, FL (US)

(73) Assignee: LED Technology Group LLC, Boca Raton, FL (US)

( * ) Notice: Subject to any disclaimer, the term of this patent is extended or adjusted under 35 U.S.C. 154(b) by 0 days.

(21) Appl. No.: 13/785,827

(22) Filed: Mar. 5, 2013

(65) Prior Publication Data

US 2013/0229104 A1 Sep. 5, 2013

Related U.S. Application Data

(60) Provisional application No. 61/606,716, filed on Mar. 5, 2012.

(51) Int. Cl.
*H01J 1/02* (2006.01)
*H01J 7/24* (2006.01)

(52) U.S. Cl.
USPC ..... 313/46; 313/11

(58) Field of Classification Search
None
See application file for complete search history.

(56) References Cited

U.S. PATENT DOCUMENTS

| | | | | |
|---|---|---|---|---|
| 6,853,151 | B2 * | 2/2005 | Leong et al. | 315/185 R |
| 8,143,769 | B2 * | 3/2012 | Li | 313/46 |
| 2010/0060130 | A1 * | 3/2010 | Li | 313/46 |
| 2011/0089830 | A1 * | 4/2011 | Pickard et al. | 315/32 |
| 2012/0001538 | A1 * | 1/2012 | Kim | 313/512 |
| 2012/0217861 | A1 * | 8/2012 | Soni | 313/46 |

* cited by examiner

*Primary Examiner* — Natalie Walford

(57) ABSTRACT

A lighting apparatus with light-emitting diode chips and a remote phosphor layer includes a plurality of LED chips, a cover, a heat sink, a first end cap, a second end cap, at least one PCB, and a LED driver. The plurality of LED chips is positioned on the at least one PCB and electronically connected with the LED driver. The LED driver is electrically connected with male contacts which traverse through the first end cap and the second end cap. The at least one PCB is enclosed with the cover, the heat sink, the first end cap, and the second end cap. The blue light and ultraviolet light from the plurality of LED chips coverts into white or yellow light from a phosphor layer of the cover, where the phosphor layer is remotely positioned from the plurality of LED chips.

9 Claims, 17 Drawing Sheets

SECTION A-A
SCALE 1 : 1.5

LIGHTING APPARATUS WITH LIGHT-EMITTING DIODE CHIPS AND REMOTE PHOSPHOR LAYER

The current application claims a priority to the U.S. Provisional Patent application Ser. No. 61/606,716 filed on Mar. 5, 2012.

FIELD OF THE INVENTION

The present invention relates generally to a lighting apparatus with light-emitting diodes. More specifically, the present invention is an apparatus that coverts blue light-emitting diode light; or any color thereof, into white or yellow light through a remote phosphor layer.

BACKGROUND OF THE INVENTION

The traditional light-emitting diode (LED) lamps comprise many individual LED bulbs which emit yellow of white color with a usual color temperature range of 2200 Kelvin (K) to 7500 K. Each of the LED diodes is encapsulated with phosphor slurry or phosphor die package which interacts with the diode or the chip of the each of the LED lamp to achieve the desired color temperature range needed. The inherent problem with this method is the thermal energy created by the LED lamps. In order for the LED lamps to efficiently function, the LED lamps have to operate in a stable temperature environment. As the thermal energy increases within the LED lamps, the phosphor slurry or the phosphor die package begins color shifting within each of the LED diodes. As LED lamp manufacturers try to cut costs, they have been skimping on the level of attention and costs needed to insure that the junction temperature and thermal properties within the LED lamps remain consistent for the many years it should last. Because of these problems, many projects completed with significant amount of white or yellow color shift over time. LED lamps have color variations within those projects even though the LED lamps are manufactured at the same time.

It is therefore an object of the present invention to provide an apparatus that provides constant white or yellow light without any color shift or color variation. The present invention remotely positions the phosphor layer from the high power LED diodes, blue LED diodes or ultraviolet LED diodes, to create white or yellow light, and a heat sink of the present invention removes the thermal energy created by the high powered LED diodes in order to improve efficiency and reliability.

DETAIL DESCRIPTIONS OF THE INVENTION

All illustrations of the drawings are for the purpose of describing selected versions of the present invention and are not intended to limit the scope of the present invention.

Figure 1:
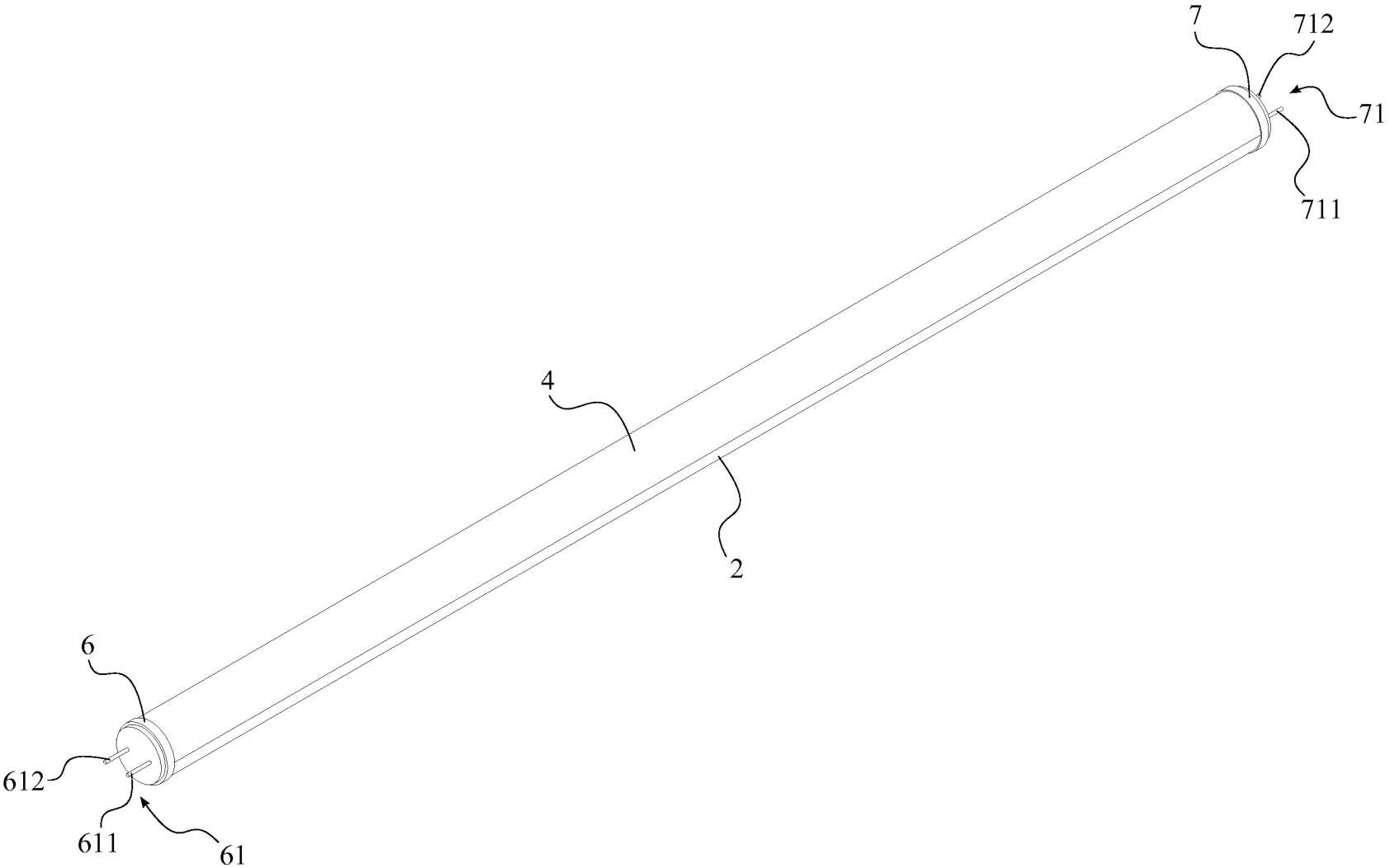
FIG. 1 is a perspective view of a preferred embodiment of the present invention.
Figure 2:
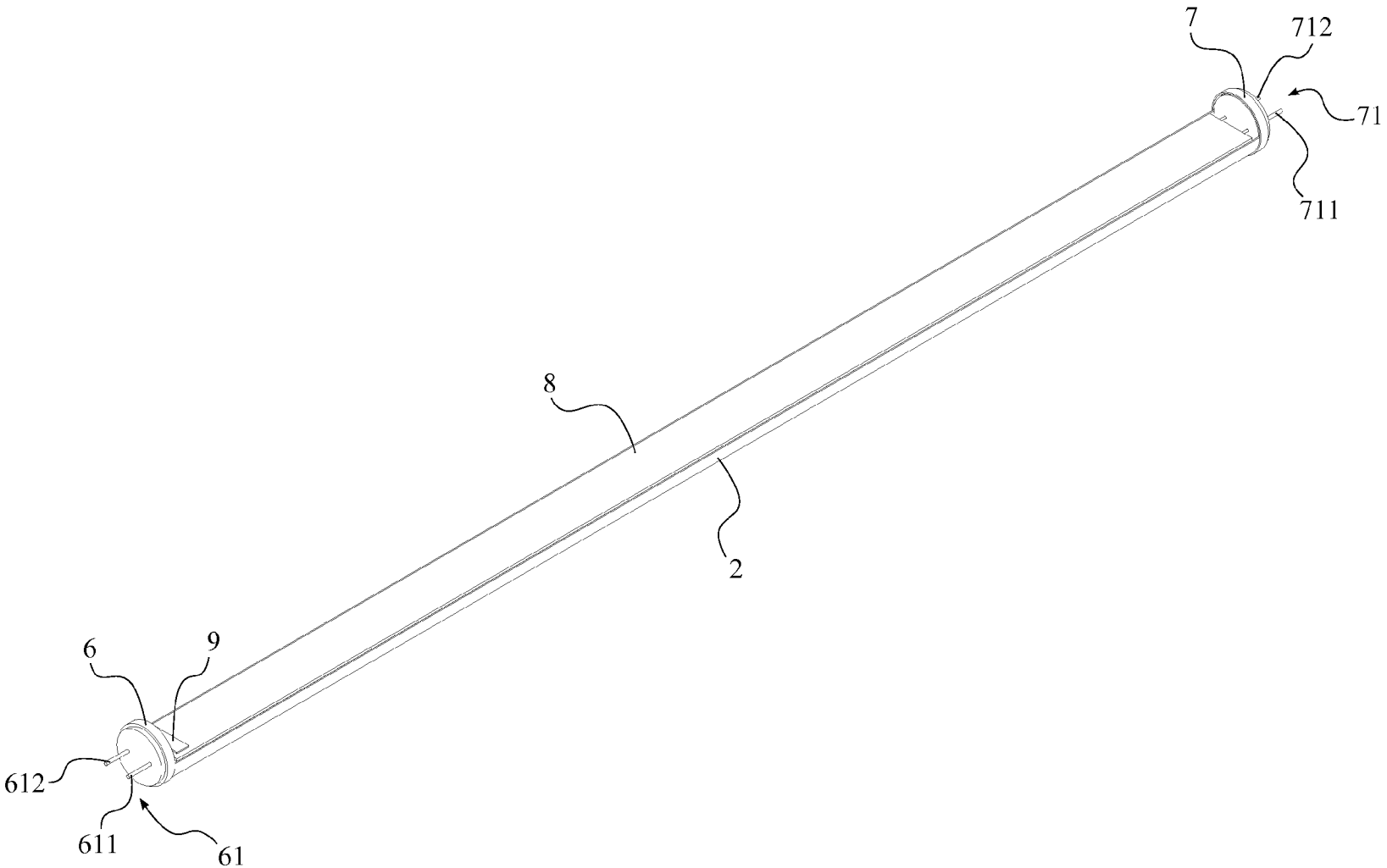
FIG. 2 is a perspective view of the preferred embodiment of the present invention without a heat sink, showing a light-emitting diode (LED) driver and a back side of at least one printed circuit board (PCB).
Figure 3:
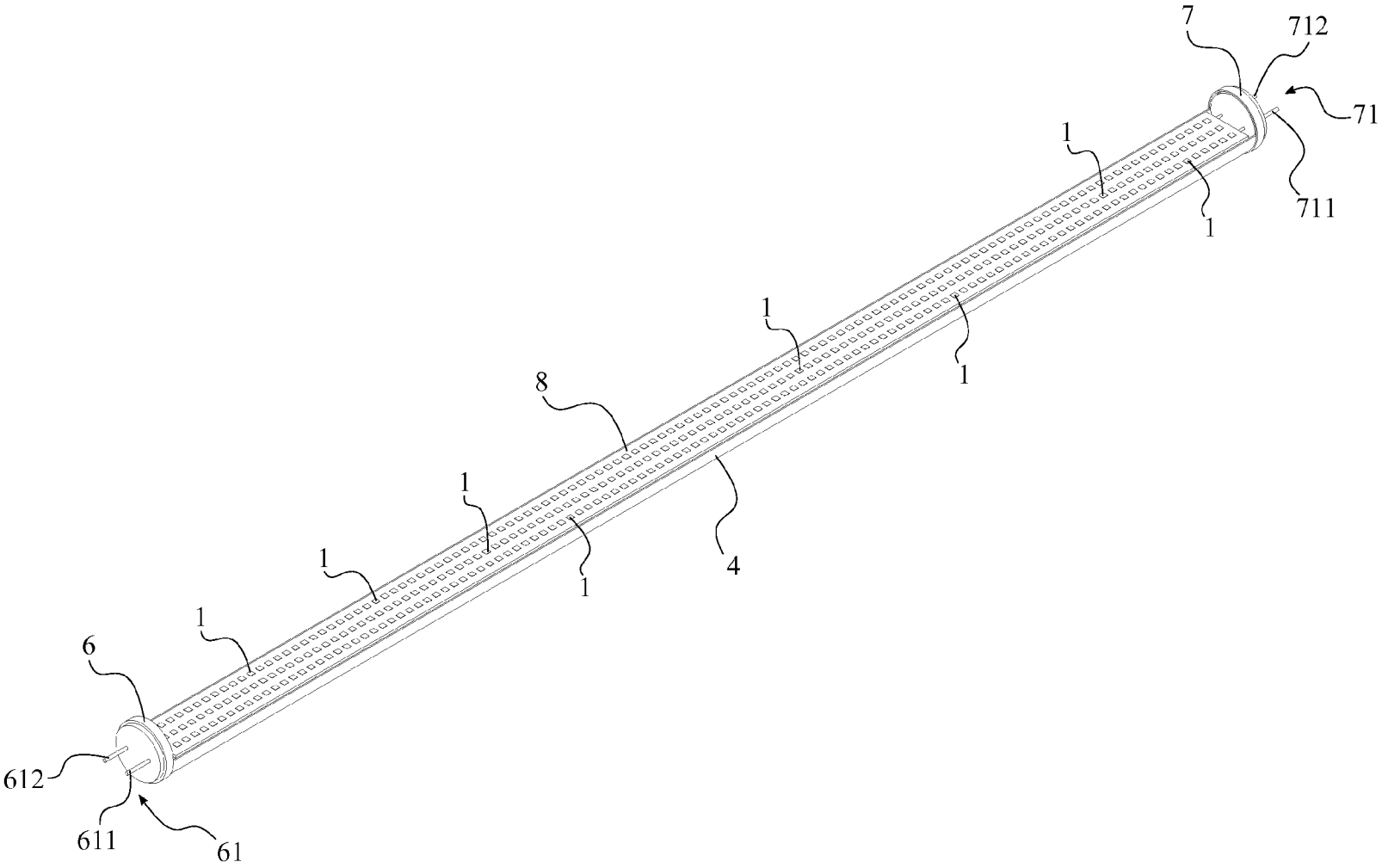
FIG. 3 is a perspective view of the preferred embodiment of the present invention without a cover, showing a plurality of the array of light-emitting diode (LED) chips.

In reference to FIG. 1, FIG. 2, and FIG. 3, the present invention is a lighting apparatus which converts an array of blue light-emitting diodes light or ultraviolet light-emitting diode light into white or yellow color. The color temperate of the white or yellow color in the present invention can range from 2200 Kelvin (K) to 7500K. The present invention comprises a plurality light-emitting diode (LED) chips 1, a cover 2, a heat sink 4, a first end cap 6, a second end cap 7, at least one printed circuit board (PCB) 8, an insulating volume 5, and a light-emitting diode (LED) driver 9. The present invention can be a single assembly of the at least one PCB 8 or a plurality of PCB 8, where the number of the at least one PCB 8 depends on the amount of light emitted by the present invention. Even though the present invention is described with at least one PCB 8, alternative embodiments of the present invention can comprise a plurality of PCBs 8.

Figure 5:
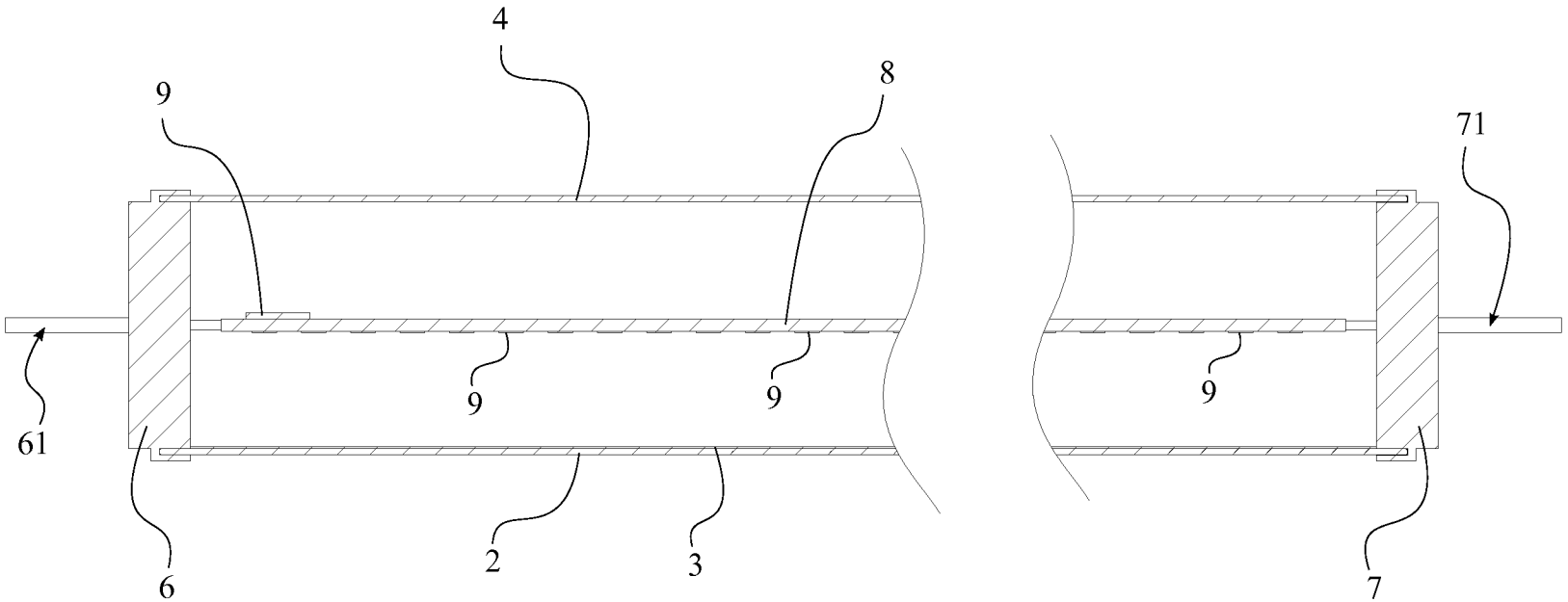
FIG. 5 is a cross section view of the preferred embodiment of the present invention taken along line A-A of FIG. 4.

The cover 2 comprises a phosphor layer 3, and the phosphor layer 3 can be any shade of white or yellow phosphor and creates the color temperature range of 2200K to 7500K. The phosphor layer 3 is adjacently positioned with the cover 2, where the cover 2 provides protection for the phosphor layer 3. The cover 2 can be, but not limited to, a clear cover, a frosted cover (also known as milky), semi-frosted cover and diffuser cover. The cover 2 can be formed into any geometric or organic shapes including, but not limited to, circular, oval, triangular, rectangular, U-shaped, V-shaped and trapezoidal. The cover 2 is made from high strength and transparent materials such as plastic, glass, and composite materials. In reference to FIG. 5 and FIG. 6, the cover 2 is adjacently positioned with the heat sink 4, and the heat sink 4 is adjacently connected to the cover 2 with any type connection mechanisms.

The heat sink 4 increases the efficiency of the present invention and the service life of the present invention as the heat sink 4 dissipates the generated thermal energy of the present invention. The heat sink 4 can be formed into any geometric or organic shapes including, but not limited to circular, oval, triangular, rectangular, U-shaped, V-shaped, and trapezoidal. The heat sink 4 is made of high strength and high thermal conductivity materials such as, aluminum alloys, copper, and composite materials.

Figure 4:
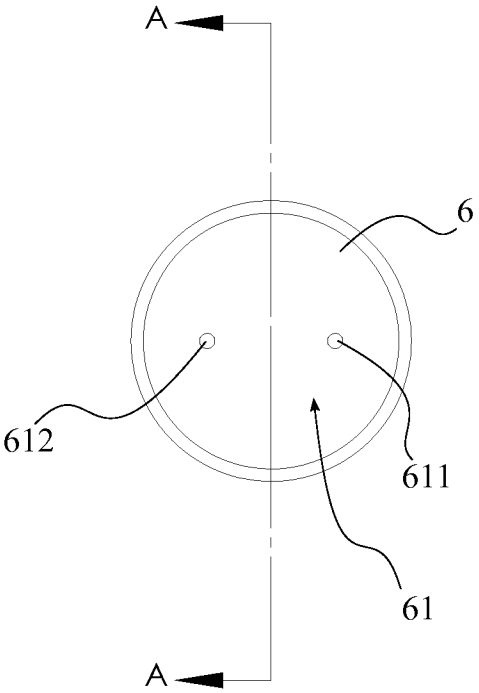
FIG. 4 is a side view of the preferred embodiment of the present invention, showing the plane upon which a cross sectional view is taken shown in FIG. 5.

In reference to FIG. 3 and FIG. 4, the first end cap 6 comprises at least one first male electrical contact 61 which traverses through the first end cap 6. Similarly the second end cap 7 comprises at least one second male electrical contact 71 which traverses through the second end cap 7. The first end cap 6 and the second end cap 7 are oppositely positioned from each other along the cover 2 and the heat sink 4, and connected with both the cover 2 and the heat sink 4 or the cover 2 at each extremity. Depending on different embodiments of the present invention, the at least one first male electrical contact 61 and the at least one second male electrical contact 71 provide the incoming voltage and current and/or structural connection to the present invention as the at least one first male electrical contact 61 and the at least one second male electrical contact 71 electrically and structurally connect the present invention with a supporting structure.

The shape of the cover 2 and the shape of the heat sink 4 determine the shape of the first end cap 6 and the second end cap 7. For example, if the cover 2 is shaped into a V-shape and the heat sink 4 is shaped into a flat shape, the first end cap 6 and the second end cap 7 are shaped into a triangular shape so that the first end cap 6 and the second end cap 7 can be connected to both the cover 2 and the heat sink 4 or the cover 2. The first end cap 6 and the second end cap 7 can be made from, but not limited to, aluminum alloys, plastic, and composite materials. The positioning of the cover 2 and the heat sink 4 determine a lighting area of the present invention, where the lighting area can range from 10 to 360 degrees. For example, if the lighting area is 270 degrees through the cover 2, the heat sink 4 blocks 90 degrees of the lighting area. The connections between the cover 2 and the heat sink 4 or the cover 2, the first end cap 6, and the second end cap 7 provide an enclosure for the rest of the components of the present invention allowing protection for those components. The enclosure of the present invention can also be a combination of the cover 2 and the heat sink 4, as the first end cap 6 and the second end cap 7 may be eliminated from the present invention. if the first end cap 6 and the second end cap 7 is be eliminated from the present invention, the at least one first male electrical contact 61 and the at least one second male electrical contact 71 traverse through either the cover 2 or the heat sink 4.

Figure 11:
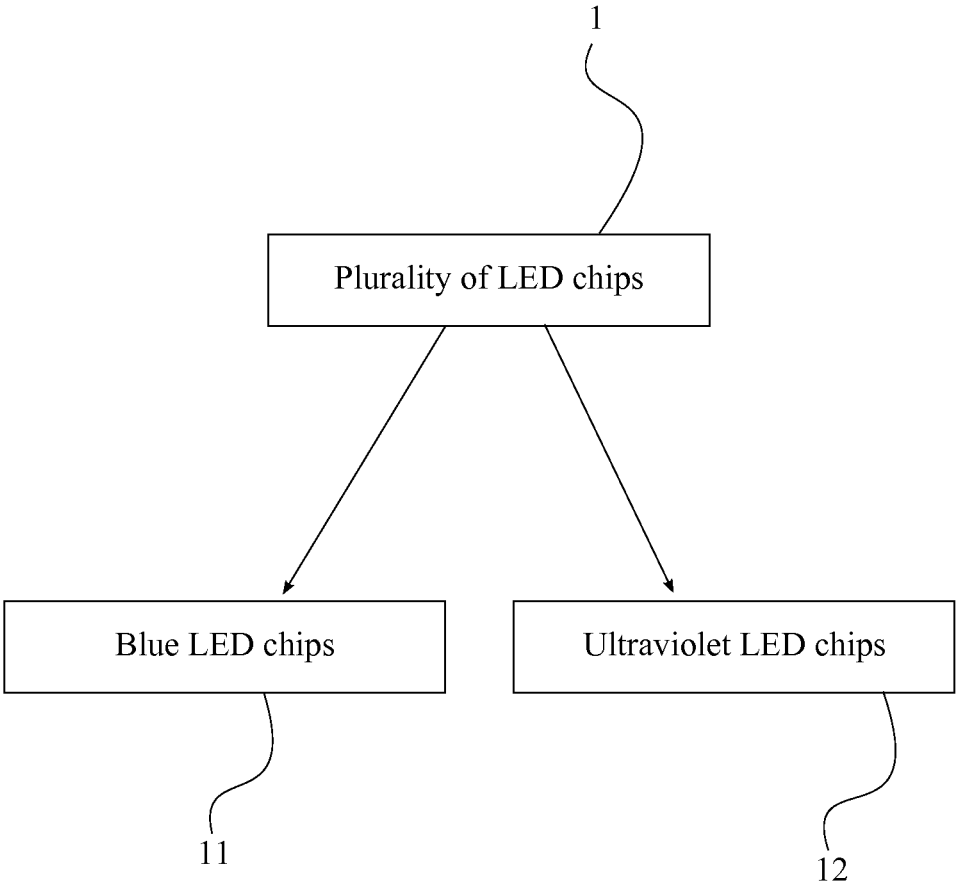
FIG. 11 is a block diagram showing blue LED chips and ultraviolet LED chips.

The plurality of LED chips 1 is positioned on the at least one PCB 8 and electronically connected to the at least one PCB 8. In reference to FIG. 11, the present invention uses either blue LED chips 11 or ultraviolet LED chips 12 as the plurality of LED chips 1. The present invention is able to use any shade of the blue LED chips, where the blue LED chips emit light wavelength range from 450 nanometers to 495 nanometers. For example, the blue LED chips can emit any shades of blue color, where the shades of blue color can include, but not limited to, blue, navy blue, royal blue, powder blue, azure, and sky blue. The present invention is also able to use the ultraviolet LED chips, where the ultraviolet LED chips emit light wavelength range from 10 nanometers to 400 nanometers. The plurality of LED chips 1 used within the present invention can be packaged or unpackaged plurality of LED chips 1.

The at least one PCB 8 is used to connect each of the plurality of LED chips 1 so that each the plurality of LED chips 1 can be efficiently and systematically arranged within the present invention. Even though the at least one PCB 8 is used within the present invention, any other type of conductive rigid or flexible pathways, such as wire wrap and point-to point construction, can be incorporated to electronically connect each of the plurality of LED chips 1. The positioning of the plurality of LED chips 1 determines the lighting area of the present invention since the plurality of LED chips 1 provides a directional lighting effect. For example, when the lighting area is 360 degrees, the positioning of the plurality of LED chips 1 is angularly arranged adjacent to the heat sink 4, where the physical size of the heat sink 4 is much smaller than the cover 2, so that the directional light can bypass the heat sink 4. The at least one PCB 8 is positioned in between the at least one first male electrical contact 61 and the at least one second male electrical contact 71, where the plurality of LED chips 1 is faced toward the phosphor layer 3, and back side of the plurality of LED chips 1 is faced toward the heat sink 4.

The LED driver 9 is an integrated circuit which converts alternating current (AC) to direct current. The LED driver 9 also manages the incoming voltage and current of the present invention to the voltage and current level requirements of the plurality of LED chips 1. The LED driver 9 can be internally or externally positioned with the present invention.

The insulating volume 5, which is the spaced between the plurality of LED chips 1 and the phosphor layer 3, is able to dissolve the thermal energy created by the plurality of LED chips 1. The insulation volume 5 of the present invention is preferably ⅛ to 2 inches in between the plurality of LED chips 1 and the phosphor layer 3. Since the phosphor layer 3 is remotely positioned from the plurality of LED chips 1, the thermal energy created from the plurality of LED chips 1 can be removed from the insulating volume 5 through the heat sink 4 without damaging the phosphor layer 3.

Figure 6:
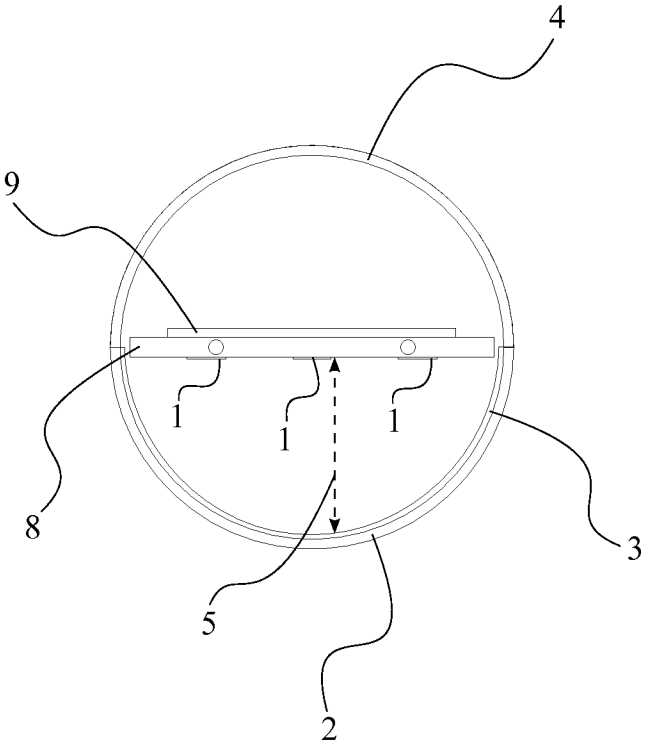
FIG. 6 is a side view of the preferred embodiment of the present invention without a first end cap and a second end cap.

In reference to FIG. 6, the preferred embodiment, the cover 2 comprises a semicircular shape, and the heat sink 4 also comprises a semicircular shape. Even though the cover 2 and the heat sink 4 of the preferred embodiment comprise the semicircular shapes, the cover 2 and the heat sink 4 of the present invention are not limited to the semicircular shape and can be any other geometric shapes or organic shapes. The heat sink 4 is positioned atop the cover 2 and securely connected to the cover 2 with the connection mechanisms, where the connection mechanisms includes, but not limited to, adhesive strips, glue, and connecting rails. When the heat sink 4 is positioned atop the cover 2, the phosphor layer 3 that is positioned on the cover 2 also gets protected from the heat sink 4. In reference to FIG. 5, the first end cap 6 and the second end cap 7 are oppositely positioned from each other along the cover 2 and the heat sink 4, and connected to the cover 2 and the heat sink 4 at each extremity. Even though the preferred embodiment uses G13 style end caps as the first end cap 6 and the second end cap 7, any other type of end cap can be used within the preferred embodiment where the shape of the cover 2 and the heat sink 4 determine the shape of the first end cap 6 and the second end cap 7. For example, if the cover 2 is shaped into an open U-shape and the heat sink 4 is shaped into a flat shape, the first end cap 6 and the second end cap 7 are shaped into a closed U-shape so that the first end cap 6 and the second end cap 7 can be simultaneously connected with the cover 2 and the heat sink 4. The connections between the cover 2, the heat sink 4, the first end cap 6, and the second end cap 7 provide the enclosure for the rest of the components of the preferred embodiment allowing protection for those components. In the preferred embodiment, the LED driver 9 can be internally positioned in between the cover 2, the heat sink 4, the at least one first male electrical contact 61, and the at least one second male electrical contact 71, where the LED driver 9 is preferably positioned on the at least one PCB 8 and adjacent with the heat sink 4. The LED driver can also be externally positioned as a separate electrical component with the at least one first male electrical contact 61.

Figure 7:
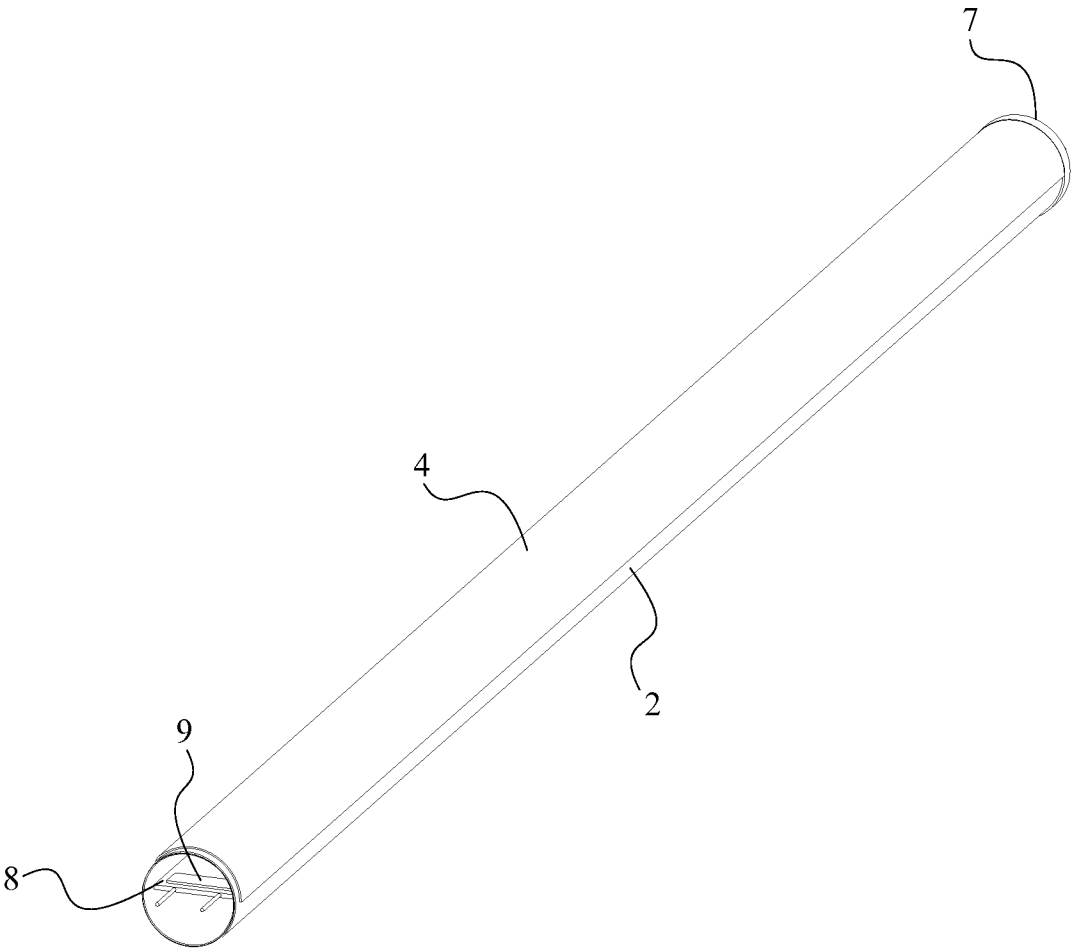
FIG. 7 is a perspective view of an alternative embodiment of the present invention without the first end cap, wherein the heat sink is externally positioned with the cover.
Figure 8:
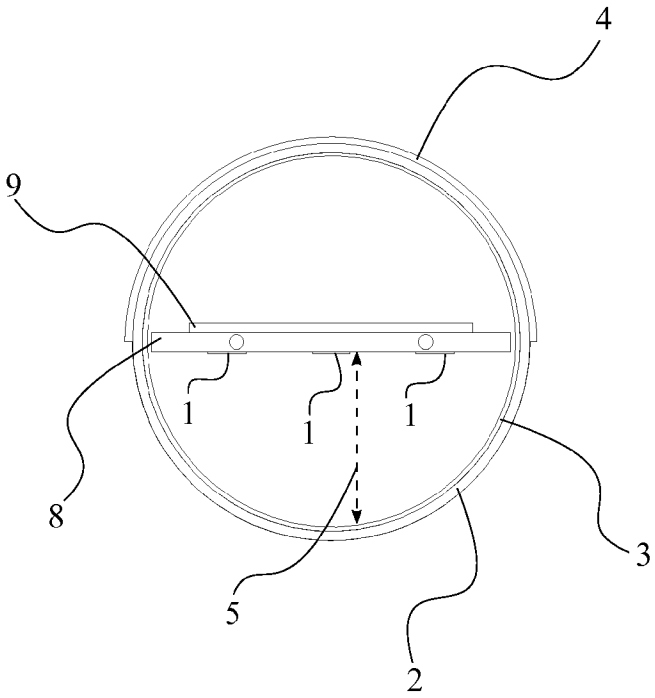
FIG. 8 is a side view of the alternative embodiment of the present invention without the first end cap and the second end cap, wherein the heat sink is externally positioned with the cover.
Figure 9:
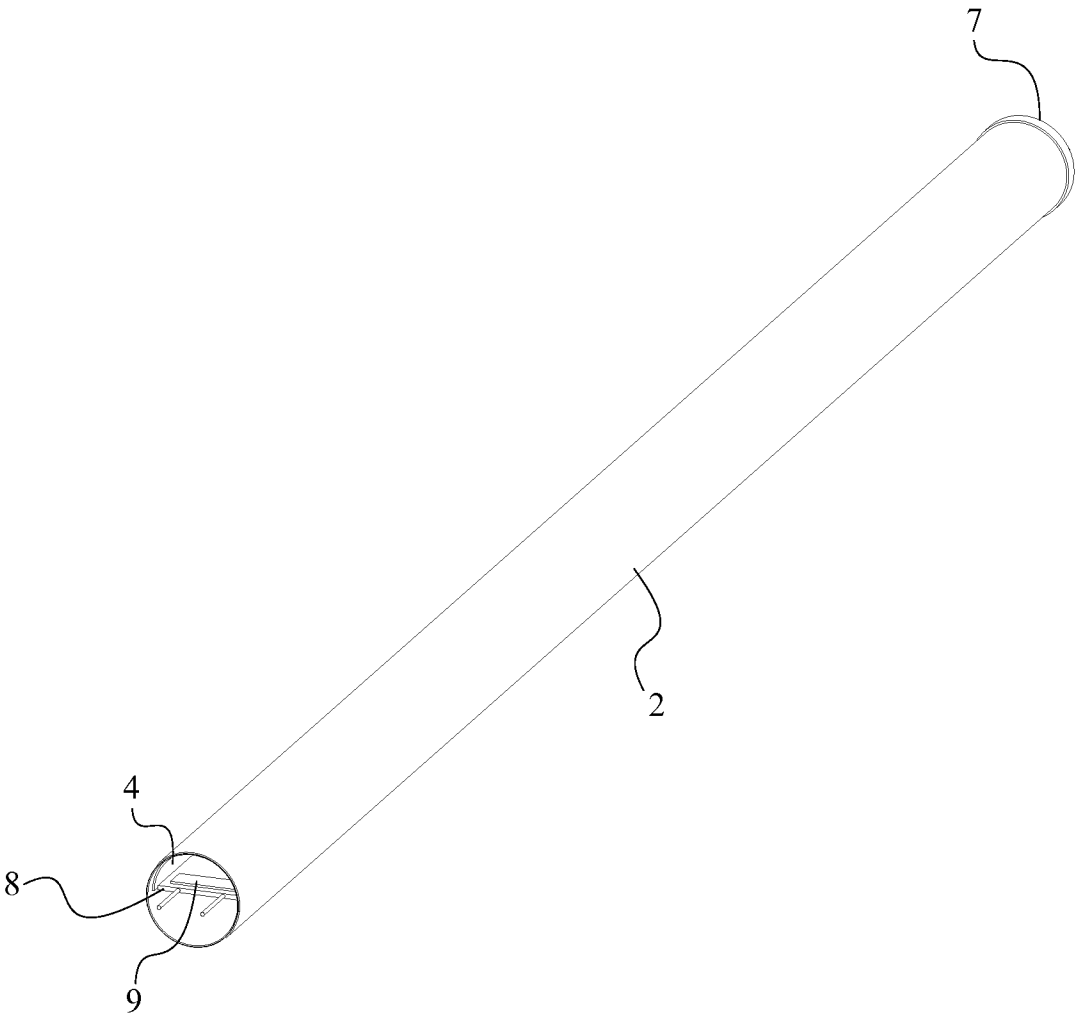
FIG. 9 is a perspective view of the alternative embodiment of the present invention without the first end cap, wherein the heat sink is internally positioned with the cover.
Figure 10:
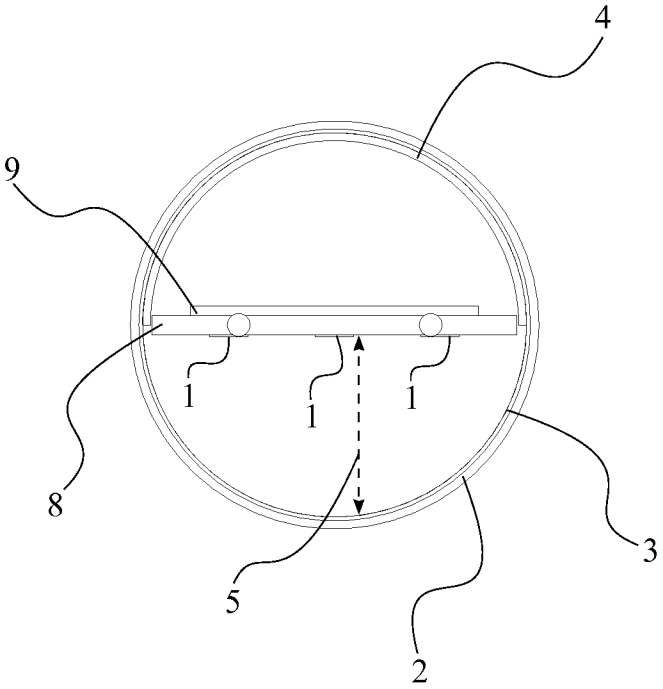
FIG. 10 is a side view of the alternative embodiment of the present invention without the first end cap and the second end cap, wherein the heat sink is internally positioned with the cover.

In reference to FIG. 7 and FIG. 9, an alternative embodiment, the cover 2 comprises a circular shape, and the heat sink 4 comprises a semicircular shape where the heat sink 4 is adjacently positioned with the cover 2. Even though the cover 2 of the alternative embodiment comprises the circular shape, the cover 2 of the present invention is not limited to the circular shape and can be any other closed geometric shapes or organic shapes. Similar to the cover 2 of the alternative embodiment, even though the heat sink 4 of the alternative embodiment comprises the semicircular shape, the heat sink 4 of the present invention is not limited to the semicircular shape and can be any other geometric shapes or organic shapes. In the alternative embodiment, the heat sink 4 is either internally or externally positioned with the cover 2. In reference to FIG. 8, the cover 2 of the alternative embodiment comprises the circular shape which is a closed geometric shape, and the semicircular shape heat sink 4 is externally positioned atop the cover 2, where the heat sink 4 is oppositely positioned from the phosphor layer 3. In reference to FIG. 10, the cover 2 of the alternative embodiment comprises the same circular shape, but the semicircular shape heat sink 4 is positioned within the cover 2, where the heat sink 4 is adjacently positioned with the phosphor layer 3. The heat sink 4 is connected to the cover 2 with the connection mechanisms, where the connection mechanisms can be, but not limited to, adhesive strips, glue, and connecting rails. The first end cap 6 and the second end cap 7 are oppositely positioned from each other along the cover 2, and connected to the cover 2 at each extremity. Even though the alternative embodiment uses G13 style end caps, any other type of end cap can be used within the alternative embodiment as the shape of the first end cap 6 and the second end cap 7 is determined by the shape of the cover 2. For example, if the cover 2 is shaped into a rectangular shape, the first end cap 6 and the second end cap 7 are also shaped into rectangular shapes so that the first end cap 6 and the second end cap 7 can be connected to the cover 2. The connections between the cover 2, the first end cap 6, and the second end cap 7 provide the enclosure for the rest of the components of the alternative embodiment allowing protection for those components while the heat sink 4 is internally or externally positioned with the enclosure. In the alternative embodiment, the LED driver 9 can be internally positioned in between the cover 2, the heat sink 4, the at least one first male electrical contact 61, and the at least one second male electrical contact 71, where the LED driver 9 is preferably positioned on the at least one PCB 8 and adjacent with the heat sink 4. The LED driver can also be externally positioned as a separate electrical component with the at least one first male electrical contact 61.

Figure 12:
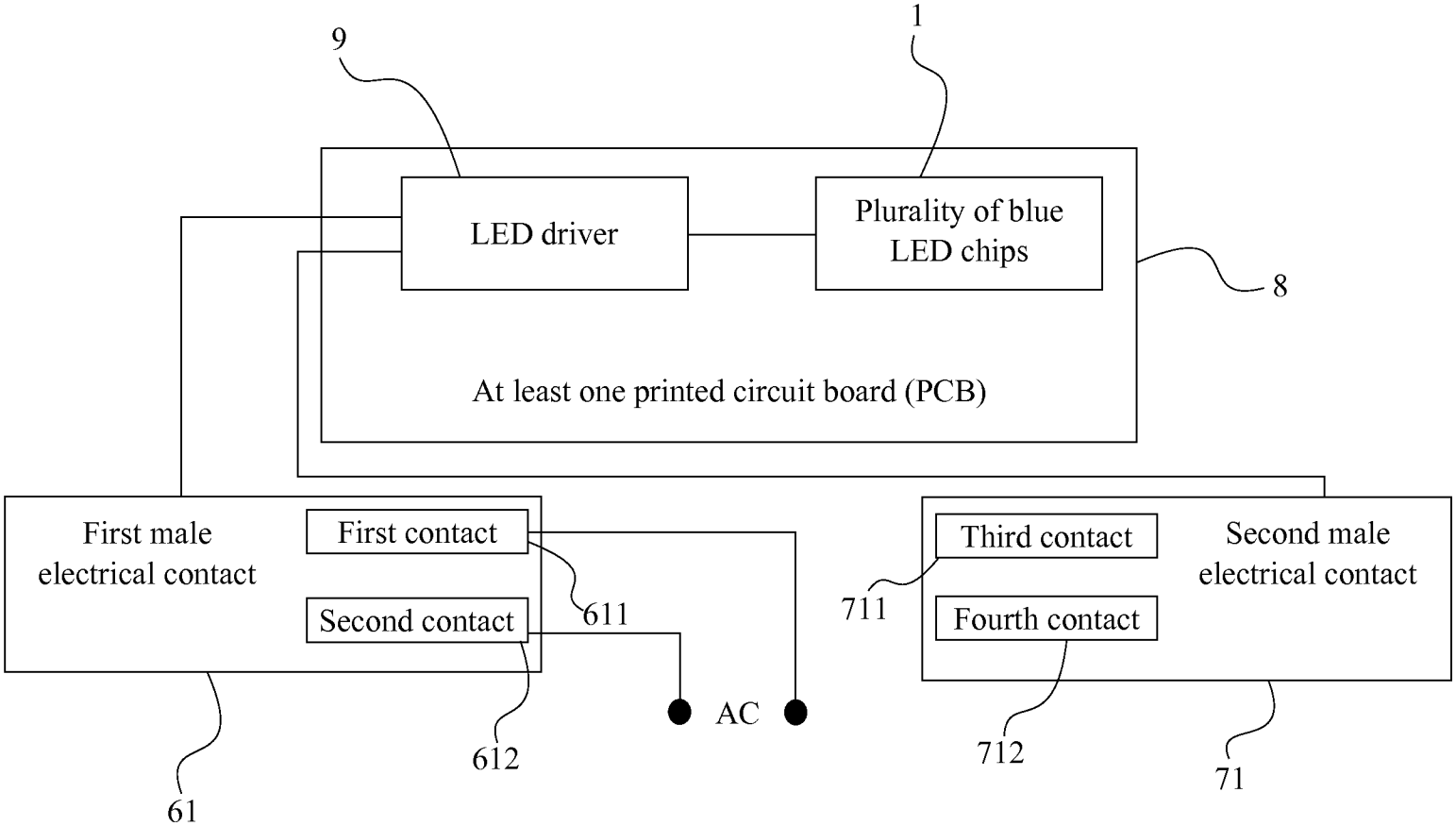
FIG. 12 is a schematic illustrating the basic electrical connection of a first contact and a second contact of the present invention, wherein the LED driver is positioned within the first end cap and the second end cap.
Figure 13:
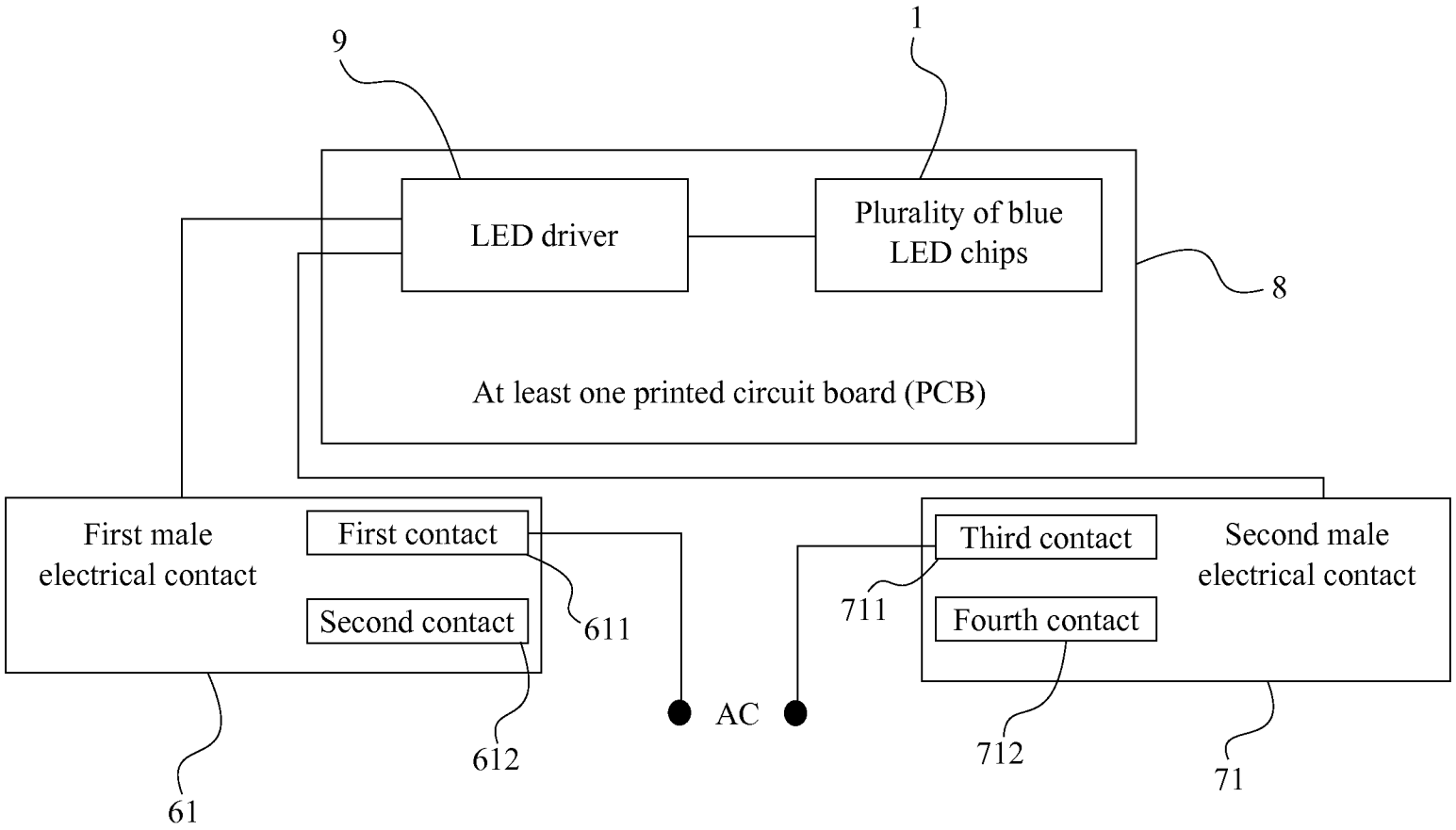
FIG. 13 is a schematic illustrating the basic electrical connection of the first contact and a third contact of the present invention, wherein the LED driver is positioned outside of the first end cap.

In reference to FIG. 12 and FIG. 13, when the LED driver 9 is internally positioned in between the at least one first male electrical contact 61 and the at least one second male electrical contact 71, the LED driver 9 is electronically connects with the plurality of LED chips 1 by the at least one PCB 8. The LED driver 9 also electrically connected with the supporting structure through the at least one first male electrical contact 61 and the at least one second male electrical contact 71 or through the at least one first male electrical contact 61, where the at least one first male electrical contact 61 comprises a first contact 611 and a second contact 612, and the at least one second male electrical contact 71 comprises a third contact 711 and a fourth contact 712. When the LED driver 9 is electrically connected through the at least one first male electrical contact 61, the first contact 611 and the second contact 612 electrically connect with the LED driver 9. Then the first contact 611 and the second contact 612 provide the incoming voltage and current of the present invention so that the plurality of LED chips 1 can be illuminated while the third contact 613 and the fourth contact 614 function as the structural support to the present invention so that the present invention can be secured with the supporting structure. When the LED driver 9 is electrically connected through the at least one first male electrical contact 61 and the at least one second male electrical contact 71, the first contact 611 and the third contact 711 electrically connect with the LED driver 9. Then the first contact 611 and the third contact 711 provide the incoming voltage and current of the present invention so that the plurality of LED chips 1 can be illuminated while the second contact 612 and the fourth contact 712 function as the structural support to the present invention so that the present invention can be secured with the supporting structure.

Figure 14:
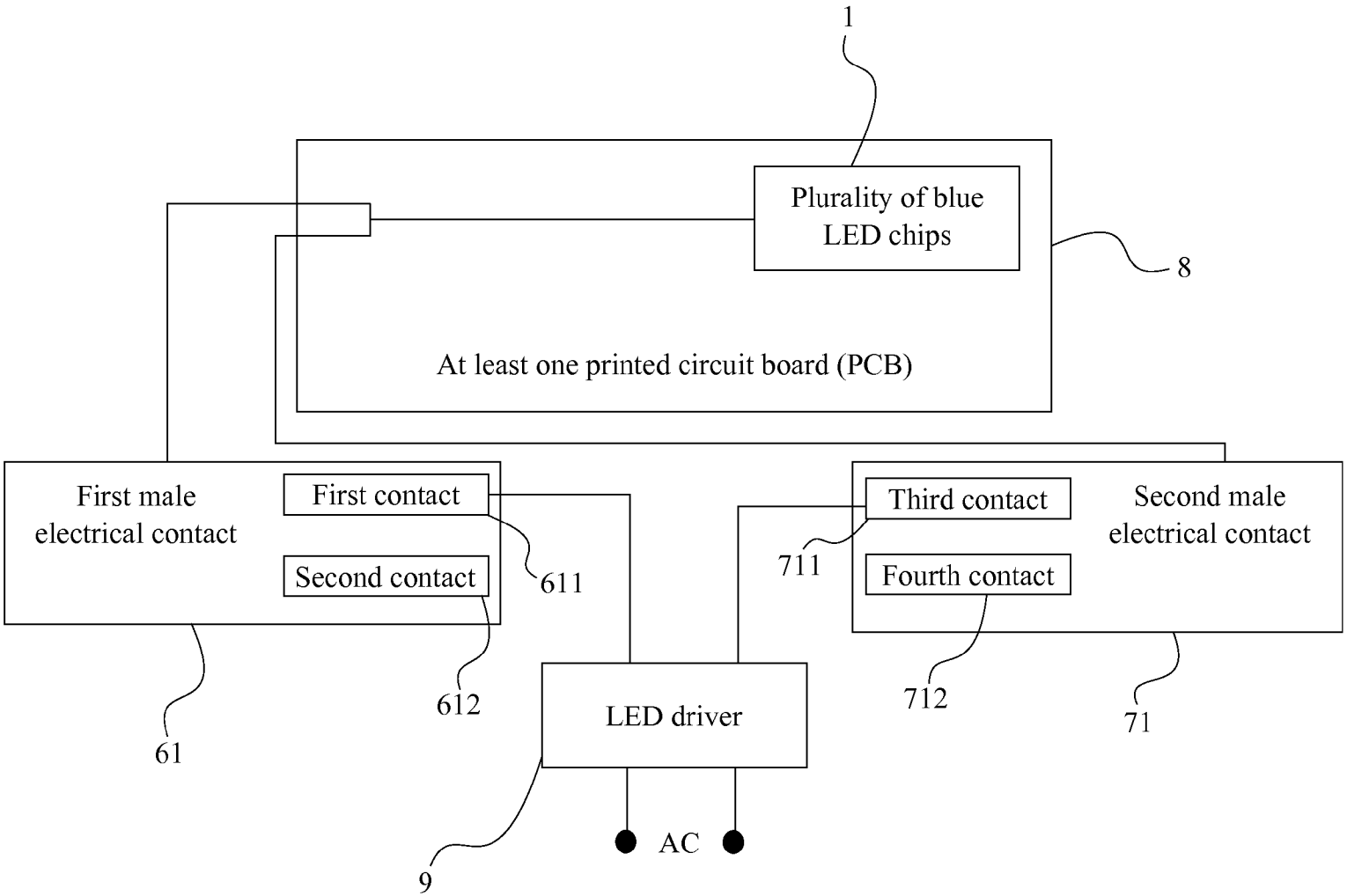
FIG. 14 is a schematic illustrating the basic electrical connection of a first contact and a second contact of the present invention, wherein the LED driver is externally positioned with the first end cap.
Figure 15:
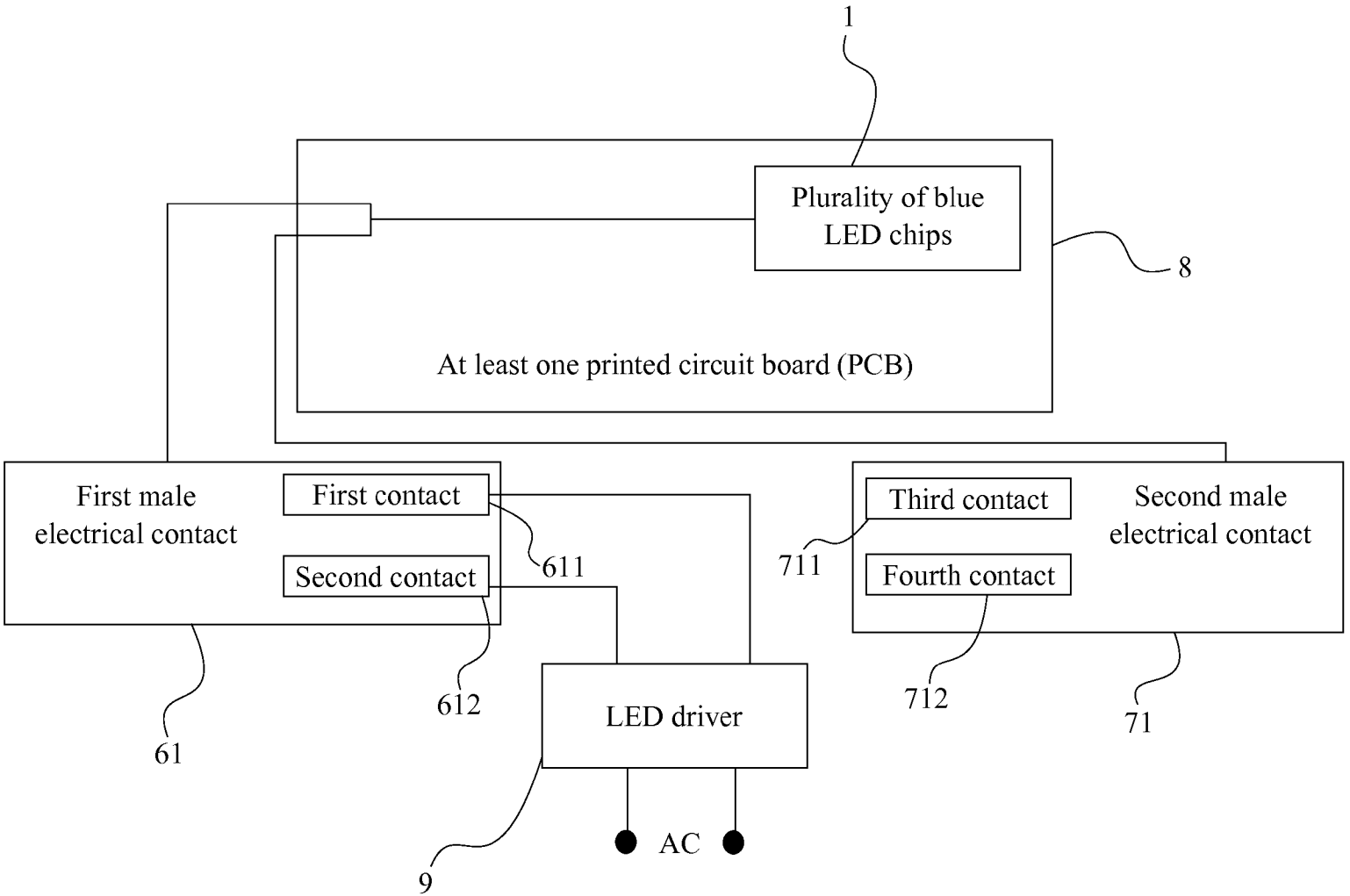
FIG. 15 is a schematic illustrating the basic electrical connection of the first contact and a third contact of the present invention, wherein the LED driver is externally positioned with the first end cap.

In reference to FIG. 14 and FIG. 15, when the LED driver 9 is externally positioned with the at least one first male electrical contact 61, the plurality of LED chips 1 electronically connects with the at least one PCB 8. The at least one PCB 8 is electrically connected with the least one first male electrical contact 61 and the at least one second male electrical contact 71 or with the at least one first male electrical contact 61, where the at least one first male electrical contact 61 comprises a first contact 611 and a second contact 612, and the at least one second male electrical contact 71 comprises a third contact 711 and a fourth contact 712. When the LED driver 9 is externally positioned and electrically connected with the at least one first male electrical contact 61, the first contact 611 and the second contact 612 electrically connect with the LED driver 9. Then the first contact 611 and the second contact 612 provide the incoming voltage and current of the present invention so that the plurality of LED chips 1 can be illuminated while the third contact 613 and the fourth contact 614 function as the structural support to the present invention so that the present invention can be secured with the supporting structure. When the LED driver 9 is externally positioned and electrically connected with the at least one first male electrical contact 61 and the at least one second male electrical contact 71, the first contact 611 and the third contact 711 electrically connect with the LED driver 9. Then the first contact 611 and the third contact 711 provide the incoming voltage and current of the present invention so that the plurality of LED chips 1 can be illuminated while the second contact 612 and the fourth contact 712 function as the structural support to the present invention so that the present invention can be secured with the supporting structure.

When the blue LED chips 11 of the plurality of LED chips 1 is power by the direct current, the blue LED chips 11 starts off with blue color, and the blue color then excites the phosphor layer 3 which converts the blue color into white or yellow color. When the ultraviolet LED chips 12 of the plurality of LED chips 1 is power by the direct current, the ultraviolet LED chips 12 also excites the phosphor layer 3 which produces white or yellow color. Since the color change from blue/ultraviolet to yellow or white takes place within the phosphor layer 3 of the cover 2, different color temperatures can be obtained by replacing cover 2. Since the phosphor layer 3 is remotely positioned from the plurality of LED chips 1, constant white or yellow color is emitted from the present invention throughout the service life of the present invention without any color shift. Since each of the plurality of LED chips 1 is not individually combined with the phosphor layer 3, and the plurality of LED chips 1 is combined with the phosphor layer 3 as a single group, color variation within each of the plurality of LED chips 1 does not take place within the present invention.

Figure 16:
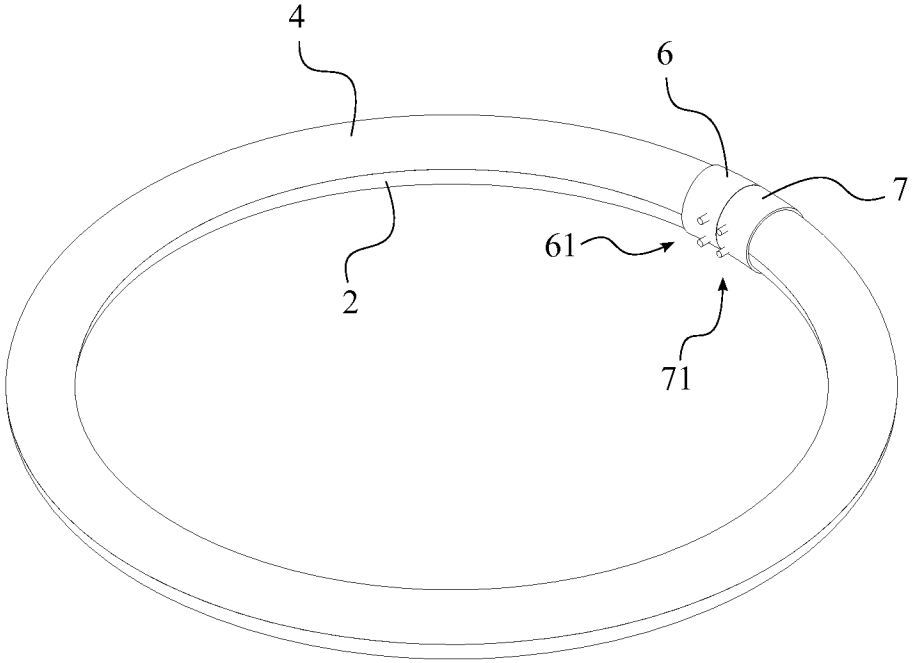
FIG. 16 is an alternative embodiment of the present invention.
Figure 17:
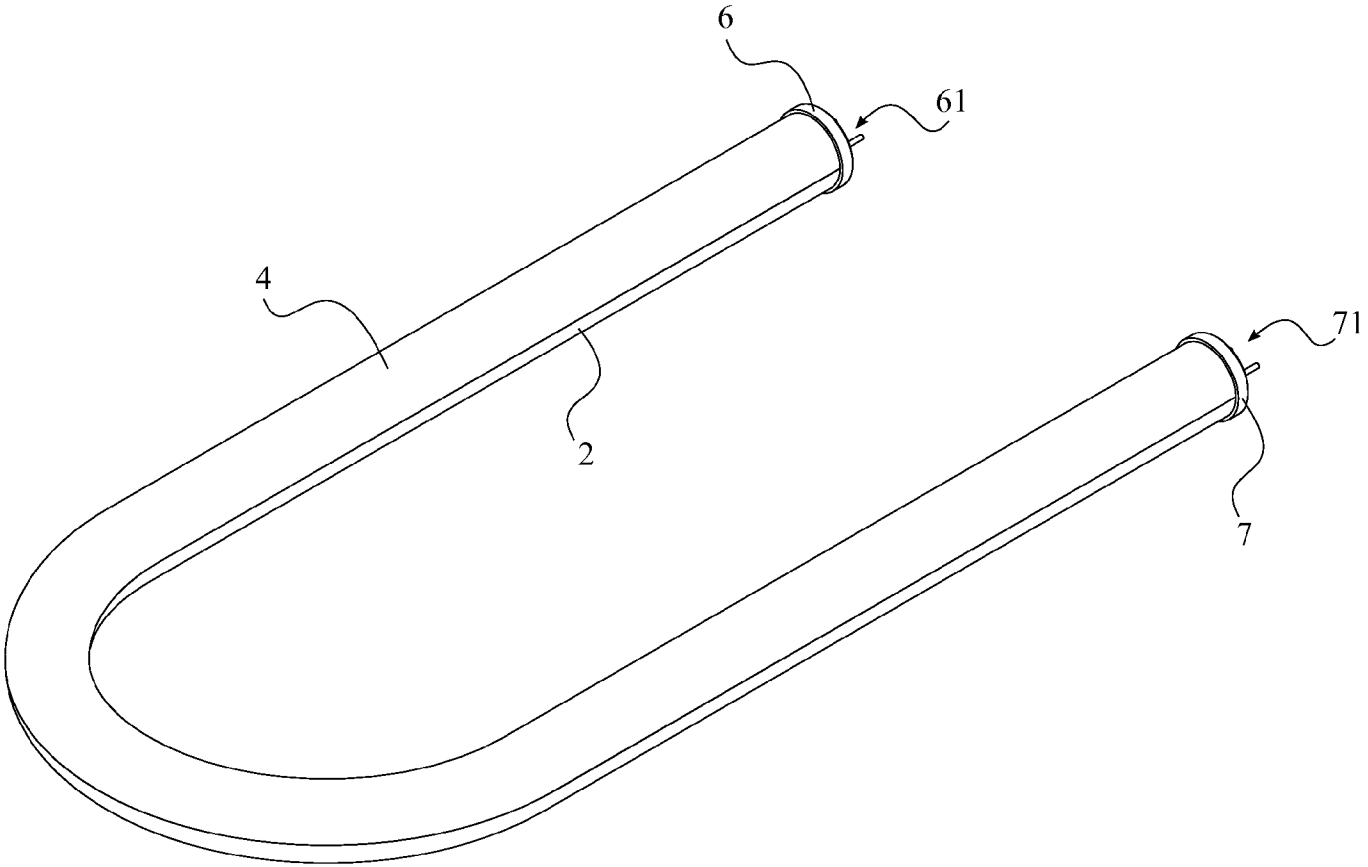
FIG. 17 is another alternative embodiment of the present invention.

The present invention can be used within any sized light emitting diode lamp formats including, but not limited to, T4, T5, T6, T8, T10, T12, TS, and TB. Even though the overall shape of the present invention describes within a linear tube shape, with reference to FIG. 16 and FIG. 17, the present invention can include, but not limited to, circular shape, U-shape, V-shape, and any other geometric and organic shapes. The present invention operates as retrofit and energy efficient alternative to florescent lamps, where minor modifications may or may not have to be done within a supporting structure of the florescent lamp so that the present invention can be functional within the supporting structure.

Although the invention has been explained in relation to its preferred embodiment, it is to be understood that many other possible modifications and variations can be made without departing from the spirit and scope of the invention as hereinafter claimed.

What is claimed is:

1. A lighting apparatus with light-emitting diode chips and a remote phosphor layer:

a plurality of light-emitting diode (LED) chips, a cover;

a heat sink;

an insulating volume;

a first end cap;

a second end cap;

at least one printed circuit board (PCB);

a light-emitting diode (LED) driver;

the cover comprises a phosphor layer;

the first end cap comprises at least one first male electrical contact;

the second end cap comprises at least one second male electrical contact;

the insulating volume being positioned in between the plurality of LED chips and phosphor layer;

the phosphor layer being adjacently positioned with the cover;

the heat sink being positioned atop the cover;

the heat sink being connected along the cover;

the first end cap and the second end cap being connected to the heat sink and the cover;

the first end cap being oppositely positioned from the second end cap along the cover and the heat sink;

the at least one first male electrical contact being traversed through the first end cap;

the at least one second male electrical contact being traversed through the second end cap;

the at least one PCB being positioned in between the at least one first male electrical contact and the at least one second male electrical contact;

the plurality of LED chips being blue LED chips, wherein the blue LED chips emit light wavelength range from 450 nanometers to 495 nanometers;

the plurality of LED chips being positioned on the at least one PCB;

the plurality of LED chips being faced toward the phosphor layer;

the plurality of LED chips being electronically connected with the LED driver by the at least one PCB;

the LED driver being adjacently positioned on the at least one PCB;

the LED driver being electrically connected with the at least one first male electrical contact; and the LED driver being positioned in between the at least one first male electrical contact and the at least one second male electrical contact.

2. The lighting apparatus with light-emitting diode chips and a remote phosphor layer as claimed in claim 1 comprises:

the at least one first male electrical contact comprises a first contact and a second contact; and the first contact and the second contact being electrically connected with the LED driver, wherein the third contact and the fourth contact of the at least one second male electrical contact provide structural support to the cover and heat sink.

3. A lighting apparatus with light-emitting diode chips and a remote phosphor layer:

a plurality of light-emitting diode (LED) chips, a cover;

a heat sink;

an insulating volume;

a first end cap;

a second end cap;

at least one printed circuit board (PCB);

a light-emitting diode (LED) driver;

the cover comprises a phosphor layer;

the first end cap comprises at least one first male electrical contact;

the second end cap comprises at least one second male electrical contact;

the phosphor layer being adjacently positioned with the cover;

the heat sink being adjacently positioned along the cover;

the first end cap and the second end cap being connected to the cover;

the first end cap being oppositely positioned from the second end cap along the cover;

the at least one first male electrical contact being traversed through the first end cap;

the at least one second male electrical contact being traversed through the second end cap;

the at least one PCB being positioned in between the at least one first male electrical contact and the at least one second male electrical contact;

the plurality of LED chips being positioned on the at least one PCB;

the plurality of LED chips being faced toward the phosphor layer;

the plurality of LED chips being electronically connected with the LED driver by the at least one PCB;

the LED driver being adjacently positioned on the at least one PCB;

the LED driver being electrically connected with the at least one first male electrical contact and the at least one second male electrical contact;

the LED driver being positioned in between the at least one first male electrical contact and the at least one second male electrical contact; and the plurality of LED chips being ultraviolet LED chips, wherein the ultraviolet LED chips emit light wavelength range from 10 nanometers to 400 nanometers.

4. The lighting apparatus with light-emitting diode chips and a remote phosphor layer as claimed in claim 3 comprises:

the heat sink being externally positioned with the cover opposite from the phosphor layer.

5. The lighting apparatus with light-emitting diode chips and a remote phosphor layer as claimed in claim 3 comprises:

the heat sink being internally positioned within the cover; and the heat sink being adjacently positioned with the phosphor layer.

6. The lighting apparatus with light-emitting diode chips and a remote phosphor layer as claimed in claim 3 comprises:

the at least one first male electrical contact comprises a first contact and a second contact;

the at least one second male electrical contact comprises a third contact and a fourth contact; and the first contact and the third contact being electrically connected with the LED driver, wherein the second contact and the fourth contact provide structural support to the cover and heat sink.

7. A lighting apparatus with light-emitting diode chips and a remote phosphor layer:

a plurality of light-emitting diode (LED) chips, a cover;

a heat sink;

an insulating volume;

a first end cap;

a second end cap;

at least one printed circuit board (PCB);

a light-emitting diode (LED) driver;

the cover comprises a phosphor layer;

the first end cap comprises at least one first male electrical contact;

the second end cap comprises at least one second male electrical contact;

the insulating volume being positioned in between the plurality of LED chips and phosphor layer.

8. The lighting apparatus with light-emitting diode chips and a remote phosphor layer as claimed in claim 7 comprises:

the plurality of LED chips being positioned on the at least one PCB;

the plurality of LED chips being faced toward the phosphor layer;

the plurality of LED chips being electronically connected with the at least one first male electrical contact and the at least one second male electrical contact by the at least one PCB;

the at least one first male electrical contact and the at least one second male electrical contact being electrically connected with the LED driver;

the LED driver being externally positioned with the at least one first male electrical contact;

the at least one first male electrical contact comprises a first contact and a second contact;

the at least one second male electrical contact comprises a third contact and a fourth contact; and the first contact and the third contact being electrically connected with the LED driver, wherein the second contact and the fourth contact provide structural support to the cover and heat sink.

9. The lighting apparatus with light-emitting diode chips and a remote phosphor layer as claimed in claim 7 comprises:

the plurality of LED chips being positioned on the at least one PCB;

the plurality of LED chips being faced toward the phosphor layer;

the plurality of LED chips being electronically connected with the at least one first male electrical contact by the at least one PCB;

the at least one first male electrical contact being electrically connected with the LED driver;

the LED driver being externally positioned with the at least one first male electrical contact;

the at least one first male electrical contact comprises a first contact and a second contact; and the first contact and the second contact being electrically connected with the LED driver, wherein the third contact and the fourth contact of the at least one second male electrical contact provide structural support to the cover and heat sink.

* * * * *